United States Patent [19]

Yarbrough

[11] Patent Number: 4,993,446

[45] Date of Patent: Feb. 19, 1991

[54] COMBINATION WALKER AND CRUTCH

[76] Inventor: Glen A. Yarbrough, 705 Louise St., Clarksville, Ark. 72830

[21] Appl. No.: 421,804

[22] Filed: Oct. 16, 1989

[51] Int. Cl.[5] ..... A61H 3/00

[52] U.S. Cl. ..... 135/67; 135/69; 135/72

[58] Field of Search ..... 135/65, 67, 69, 71, 135/73, 75, 84, 68

[56] References Cited

U.S. PATENT DOCUMENTS 3,690,652 9/1972 Schneider ..... 135/67 X
4,748,994 6/1988 Schultz et al. ..... 135/67
4,800,911 1/1989 Endres et al. ..... 135/67
4,830,035 5/1989 Liu ..... 135/67

*Primary Examiner*—David A. Scherbel
*Assistant Examiner*—Lan Mai
*Attorney, Agent, or Firm*—Dowell & Dowell

[57] ABSTRACT

A combination invalid walker and crutch which includes a four-leg walker base having a pair of horizontally oriented hand grips which enable the base to be used as a conventional walker and to which a pair of vertically adjustable underarm crutch supports are selectively mounted to thereby enable the apparatus to be used as a walker while providing the underarm support of a crutch.

10 Claims, 2 Drawing Sheets

COMBINATION WALKER AND CRUTCH

BACKGROUND OF THE INVENTION

Field of the Invention

This invention is generally related to invalid walkers which include a base providing a support frame having four legs and more specifically to an invalid walker which may be provided with additional patient support by including selectively vertically adjustable underarm crutch members that are telescopically mounted to the support base frame.

Conventional walkers generally include a base defined by a pair of sides which include front and rear legs which are connected by at least a horizontally oriented hand-grip portion. The front legs of each side are generally connected by a reinforcing frame so that a person may stand intermediate the sides and obtain vertical support from the legs of the walker.

SUMMARY OF THE INVENTION

A combination invalid walker and crutch which includes a walker base having a pair of side frames having front and rear leg posts which are generally hollow and which are connected adjacent there upper ends by a horizontal bar having a hand-grip secured thereto. The side frames are additionally reinforced by providing second horizontal braces which extend intermediate the upper and lower ends of the legs. The front legs of the side frames are connected so as to be pivotably moveable with respect to one another by a forwarded brace which includes a pair of spaced tubular sleeves through which the front legs are received. Appropriate locking means are carried by each sleeve so as to selectively secure the legs within the sleeves. The sleeves are connected by a pair of opposing V-shaped braces. A pair of vertically adjustable crutch members having front and rear vertical posts are selectively mounted within the hollow tubular legs and are telescopically adjustable with respect thereto. A horizontal underarm support member is mounted to the upper ends of each pair of front and rear support posts and such underarm support is formed of an outer sleeve in which and inner sleeve is freely slidably received. Appropriate padding may be provided around the outer sleeve of the underarm support.

To provide additional support for an individual's hands when the crutch members are mounted to the walker base, a pair hand grips are mounted to sleeves which are slidably adjustable along the front posts of the crutch members.

It is a primary object of the present invention to provide an invalid support apparatus which provides the utility of a conventional walker but which may be modified to also provide support for the underarms of a patient including vertically adjustable crutch members which are selectively and adjustably mounted to the legs of the walker base of the apparatus.

It is also an object of the present invention to provide a combination walker and crutch invalid appliance which includes hand grips which may be selectively adjustably mounted to vertically adjustable crutch elements that are mounted with respect to a walker type base.

It is yet a further object of the present invention to provide a combination invalid walker and crutch apparatus wherein the side portions of the apparatus may be folded relative to a forward support frame so that the overall apparatus may be folded into a generally compact configuration for transportation.

It is another object of the present invention to provide a combination walker and crutch apparatus which includes underarm supports which are horizontally adjustable automatically depending upon the angle of inclination of the front and rear elements of the crutch supports.

DESCRIPTION OF THE PREFERRED EMBODIMENT

Figure 1:
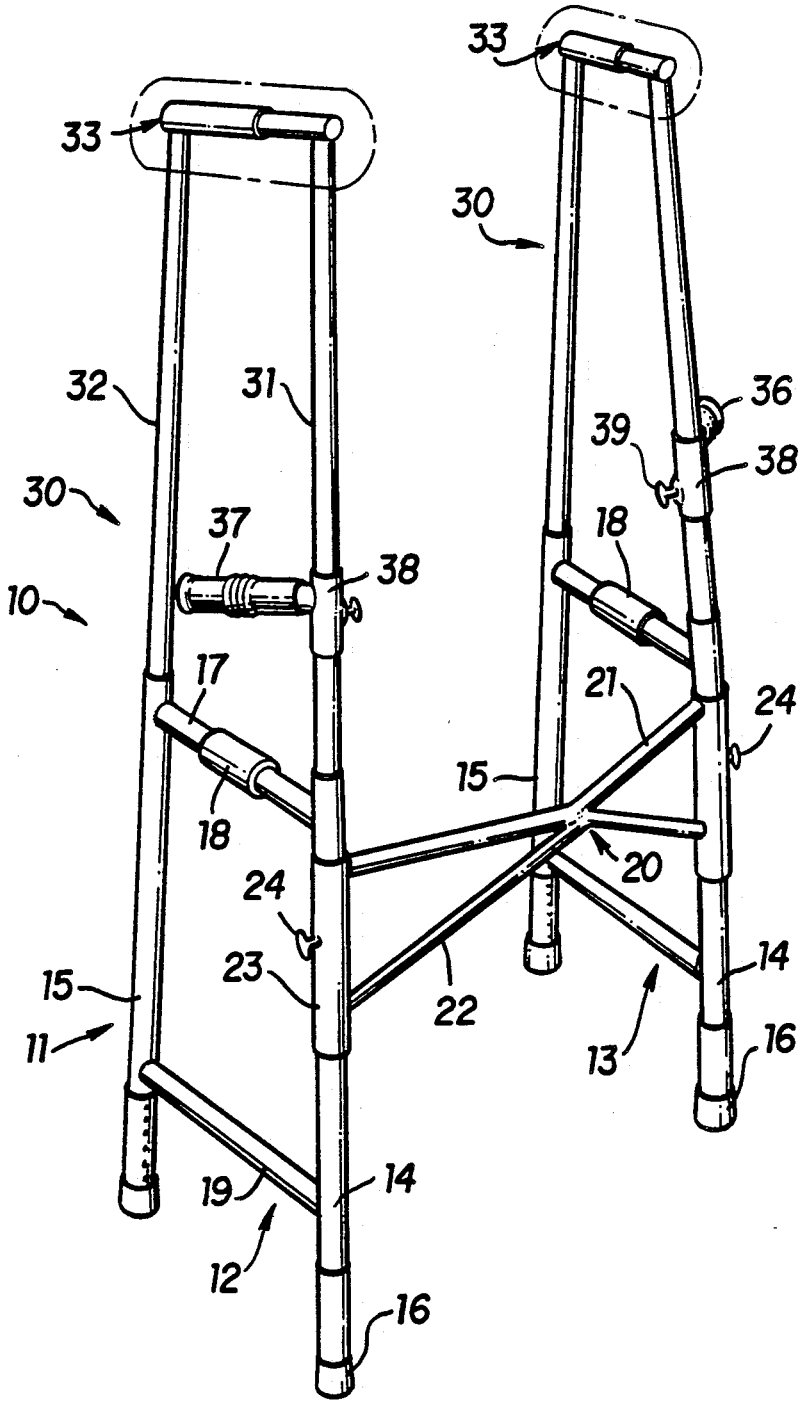
FIG. 1 is a front perspective view of the invalid walker and crutch of the present invention.

With continued reference to the drawings, the combination walker and crutch 10 of the present invention includes a walker base 11 having a pair of side frames 12 and 13. Each side frame 12 and 13 includes a front leg 14 and a rear leg 15. Each of the legs 14 and 15 is formed of a hollow tubing and preferably a lightweight aluminum tubing. Appropriate pads 16 are applied to the lower end of each of the front and rear legs 14 and 15. Each of the front and rear legs 14 and 15 are united by a horizontal support bar 17 about which appropriate hand grips 18 are selectively disposed. Further reinforcing of the side frames 12 and 13 is provided by a lower horizontal bar 19 which is mounted intermediate the upper and lower ends of each of the legs 14 and 15.

Appropriate support for the side frames is provided by a front brace assembly 20 which includes a pair of opposing V-shaped tubular elements 21 and 22 which are shown as being in a butting relationship along the intermediate portion of their lengths. The outer ends of each of the brace elements 21 and 22 are mounted to tubular sleeves 23 which are mounted in surrounding relationship with respect to the legs 14 of the walker base. In this manner, the reinforcing frame 20 may be vertically adjustable along a portion of the legs 14. In order to secure the reinforcing frame in a specific vertical relationship with respect to the walker base, locking screws 24 are provided through the sleeves 23. The mounting arrangement between the reinforcing frame 20 and the side frames 12 and 13 are such that if the locking screws 24 are loosened, the side frames 12 and 13 may be pivotably rotated in the sleeves 23 toward one another so that the side frames may be folded in a generally overlapping relationship with respect to one another and the reinforcing frame 20. This adjustment facilitates the collapse of the walker base in order to make the walker base compact for easy transport.

As described, the walker base may be utilized as any conventional walker by an individual standing intermediate the side frames 12 and 13. By utilizing the hand grips 18, an individual may support their body as they walk advancing the walker base in front of them each time a step is made in a forward direction. To further allow for the distribution of weight and to aid in the comfort of the individual, a pair of crutch members 30 may be telescopically received and adjustable mounted with respect to the walker base 11.

Each crutch member 30 includes a front post 31 which is slidable received within the hollow legs 14 of the side portion of the side frames 12 and 13. The crutch members also include rear posts 32 which are slidably received within the hollow legs 15 of each of the side frames 12 and 13. Any suitable type of locking means such as the type of locking means shown with respect to sleeves 23 may be utilized to secure the crutch members 30 in a vertically adjusted position within the front and rear legs 14 and 15.

Figure 2:
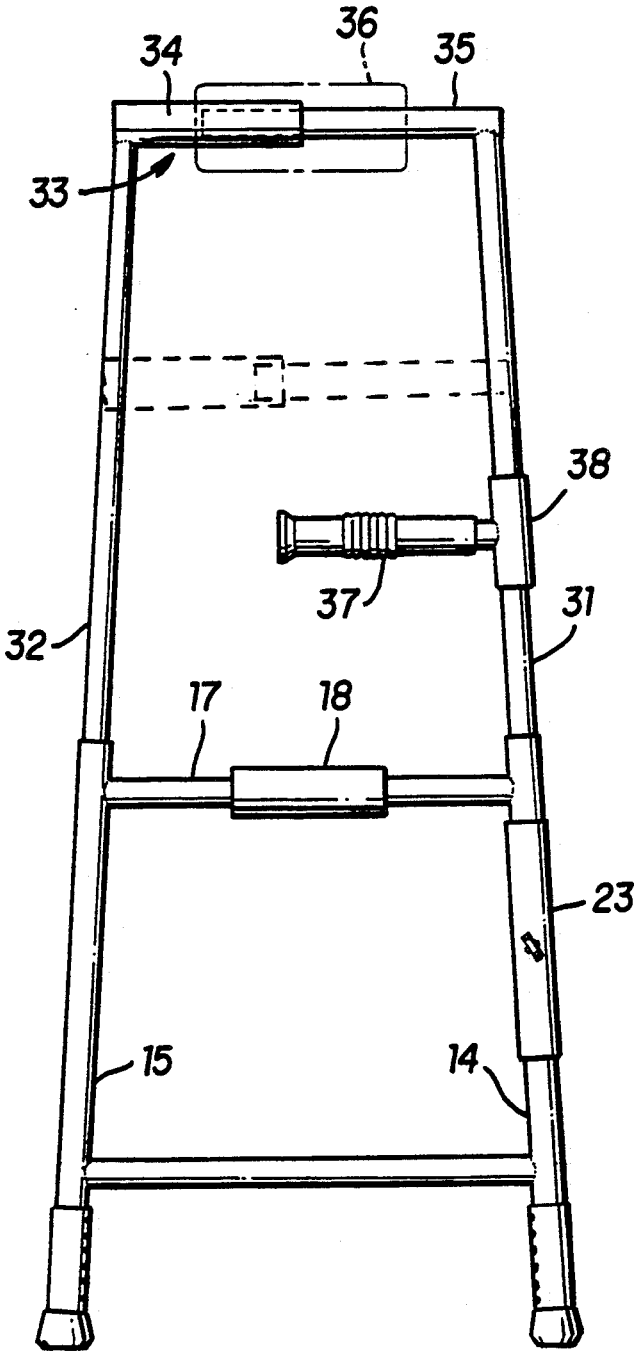
FIG. 2 is a right elevational view of the combination walker and crutch of FIG. 1 showing the adjustment to the underarm support in dotted line relative to the vertical adjustment of the crutch members.

With specific reference to FIG. 2 of the drawings, vertical underarm supports 33 are mounted to the upper ends of each of the posts 31 and 32. The underarm supports are automatically horizontally adjustable so as to compensate for the angle of inclination of the post 31 and 32. More specifically, and as shown in dotted line in FIG. 2, when the underarm supports are raised to a first elevation with respect to the base the space between the upper ends of the posts 31 and 32 will be at a first distance. However, if the posts 31 and 32 are raised to a greater vertical height then the posts will be spaced in a closer proximity with respect to one another than the first distance shown in dotted line. Therefore, the underarm support must compensate for the spacing between the front and rear posts. As shown in the drawings, in order to allow for such adjustment, a first tubular member 34 is secured to the rear post 32 and slidingly receives a tube 35 extending horizontally from the upper end of the forward posts 31. In order to provide user comfort, a pad member 36 is provided in surrounding relationship with respect to the outer tubular element 33.

To provide further support and aid in the use of the combination walker and crutch of the present invention, a pair of hand grips 37 may be mounted to forward posts 31 of the crutch members 30. The hand grips are connected to sleeves 38 which are slidingly mounted in encircling engagement with the posts 31 and may be selectively secured thereto by locking screws 39.

In use, when the crutch members 30 are mounted to the walker base additional support is provided to the patient through the underarm support members 33. In addition, the individual may utilize the hand grips 37 for assistance in walking with the combination walker and crutch apparatus.

I claim:

1. An invalid support apparatus comprising a walker base, said walker base including a pair of side frames having front and rear leg posts, reinforcing frame means for connecting said front leg posts of each of said side frames together in spaced relationship with respect to another, each of said front and rear leg posts having upper and lower ends, a first horizontal reinforcing member extending between said front and rear leg posts of each of said side frames adjacent the upper ends thereof, a crutch member selectively mounted to each of said side frames, each crutch member having front and rear posts, said front posts being vertically adjustably mounted to each of said front leg posts of said side frames, each of said rear posts of said crutch members being vertically adjustably mounted to said rear leg posts of said side frames whereby said crutch members may be vertically adjustable relative to said walker base, said front and rear posts of said crutch members having upper ends, and underarm support means being mounted to said upper ends of front and rear post means.

2. The invalid support apparatus of claim 1 in which said underarm support member includes a tubular sleeve mounted to one of said front and rear posts of said crutch members and a tubular element mounted to the other of said front and rear posts, said tubular elements being slidable received within said tubular sleeve whereby said front and rear posts may be horizontally adjustable with respect to one another.

3. The invalid support apparatus of claim 2 including padding means mounted about said underarm tubular sleeve means.

4. The invalid apparatus of claim 3 in which said reinforcing frame means includes outer tubular sleeves, said outer tubular sleeves being vertically adjustable relative to said front legs of said walker base, and means for securing said tubular sleeves to said front legs of said walker base.

5. The invalid walker of claim 4 including hand grip means mounted to said horizontal reinforcing members of said side frames.

6. The invalid walker of claim 5 including hand grip means mounted to each of said front posts of said crutch members, and means for adjustably mounting said hand grip means to said front posts.

7. The invalid apparatus of claim 1 in which said reinforcing frame means includes outer tubular sleeves, said outer tubular sleeves being vertically adjustable relative to said front legs of said walker base, and means for securing said tubular sleeves to said front legs of said walker base.

8. The invalid walker of claim 7 including hand grip means mounted to said horizontal reinforcing members of said side frames.

9. The invalid walker of claim 1 including hand grip means mounted to each of said front posts of said crutch members, and means for adjustably mounting said hand grip means to said front posts.

10. The invalid support apparatus of claim 9 in which said underarm support member includes a tubular sleeve mounted to one of said front and rear posts of said crutch members and a tubular element mounted to the other of said front and rear posts, said tubular elements being slidable received within said tubular sleeve whereby said front and rear posts may be horizontally adjustable with respect to one another.

* * * * *